US005193379A

United States Patent [19]

Ferraro

[11] Patent Number: 5,193,379

[45] Date of Patent: Mar. 16, 1993

[54] DIELESS COMPRESSION HEAD

[75] Inventor: Neil P. Ferraro, Merrimack, N.H.

[73] Assignee: Burndy Corporation, Norwalk, Conn.

[21] Appl. No.: 737,559

[22] Filed: Jul. 26, 1991

Related U.S. Application Data

[63] Continuation of Ser. No. 589,331, Sep. 27, 1990, abandoned.

[51] Int. Cl.[5] ..... H01R 43/042

[52] U.S. Cl. ..... 72/412; 72/453.16; 29/751; 29/753

[58] Field of Search ..... 72/412, 453.16, 410, 72/409; 29/753, 751

[56] References Cited

U.S. PATENT DOCUMENTS

| | | | |
|---|---|---|---|
| 1,743,364 | 1/1930 | Liss | 29/753 |
| 2,741,023 | 4/1956 | Rafter | 29/413 |
| 2,758,491 | 8/1956 | Buchanan | 29/753 |
| 2,897,703 | 8/1959 | Fischer | 72/453.16 |
| 2,968,043 | 1/1961 | Demler | 72/453.16 |
| 3,644,989 | 2/1972 | Morby | 29/628 |
| 3,862,482 | 1/1975 | Green | 29/753 |
| 4,136,549 | 1/1979 | Lytle et al. | 72/453.16 |
| 4,322,123 | 3/1982 | Newell | 29/751 |
| 4,342,216 | 8/1982 | Gregory | 72/453.16 |
| 4,604,890 | 8/1986 | Martin | 72/453.16 |
| 4,667,507 | 5/1987 | Eriksson | 73/49.7 |
| 4,934,172 | 6/1990 | Bush et al. | 72/410 |
| 4,947,672 | 8/1990 | Pecora et al. | 72/453.16 |

FOREIGN PATENT DOCUMENTS

| | | | |
|---|---|---|---|
| 1951719 | 6/1970 | Fed. Rep. of Germany | 72/416 |
| 707828 | 1/1980 | U.S.S.R. | 29/753 |

*Primary Examiner*—Daniel C. Crane
*Attorney, Agent, or Firm*—Perman & Green

[57] ABSTRACT

An electrical connector crimping tool has a head with a stationary anvil and a movable ram. The anvil has two angled contact surfaces for contacting a connector. The ram has a front with a pyramid and angled side portions. The pyramid is suitably sized and shaped such that the angled side portions of the ram can contact the anvil angled contact surfaces to stop forward advancement of the ram without the pyramid contacting the anvil.

11 Claims, 1 Drawing Sheet

DIELESS COMPRESSION HEAD

This is a continuation of copending application Ser. No. 07/589,331 filed on Sept. 27, 1990, now abandoned.

BACKGROUND OF THE INVENTION

1. Field of the Invention

The present invention relates to compressing articles and, more particularly, to a dieless compression head and a method of crimping electrical connectors onto conductors.

2. Prior Art

It is well known in the art to terminate electric cables by inserting an end of a cable into a connector which is then compressed or indented so as to form a mechanical and electrical connection between the cable and connector. U.S. Pat. No. 3,644,989 to Morby discloses a compression indenting tool with a piston that carries a punch with the overall form of a four-sided pyramid. U.S. Pat. No. 4,136,549 to Lytle et al. discloses a hydraulic compression tool with a dieless compression head used in crimping or compressing connectors to cables. Although dieless compression heads, also known as universal compression heads, have been known and used in the past to crimp a variety of size connectors and conductors, a problem nonetheless existed in the prior art in that the universal compression heads were unable to crimp all sizes of connectors and conductors with the same degree of quality. In order to properly crimp a relatively large connector with a relatively large conductor, such as a 1000 MCM wire size conductor, the front of the indentor needs to be broad to prevent the indentor from inadvertently piercing through the connector rather than properly compressing the connector. However, in order to properly crimp a connector onto a relatively small conductor, such as a 6 AWG wire size conductor, the front of the indentor should be narrow such that the indentor can indent the connector and not merely flatten the connector which would not produce a good crimp. The prior art universal compression heads have been unable to adequately support both of these divergent requirements and provide the same type of quality connections for a full range of connectors and conductors sizes.

It is therefore an objective of the present invention to overcome problems in the prior art as well as provide additional features.

SUMMARY OF THE INVENTION

The foregoing problems are overcome and other advantages are provided by a dieless compression head for use in a compression tool and a method of crimping an electrical connector to a conductor.

In accordance with one embodiment of the invention, an electrical connector crimping tool is provided comprising a frame, a ram, an anvil, and means for moving the ram relative to the anvil. The ram is movably mounted to the frame and has a front with a first portion having two angled sides, and a second portion having a general pyramid shape. The second portion forms a leading tip of the ram and the first portion is located longitudinally behind the second portion. The anvil is connected to the frame and has two angled sides adapted to be matingly contacted by the ram first portion angled sides when the ram is advanced into contact with the anvil. The means for moving the ram can move the ram relative to the anvil to crimp an electrical connector therebetween.

In accordance with another embodiment of the present invention, a head for a compression tool is provided comprising a frame, an anvil, and a ram. The anvil is connected to the frame and has two angled contact surfaces. The ram is movably mounted to the frame for movement towards and away from the anvil angled surfaces. The ram has a front with a pyramid shape and two angled side portions located behind the pyramid shape which are adapted to matingly contact the anvil angled side portions. The pyramid shape is suitably sized so as not to contact the anvil when the ram side portions contact the anvil contact surfaces.

In accordance with one method of the present invention, a method of crimping an electrical connector to a conductor is provided. The method includes providing a compression tool having a compression head with an anvil surface, a ram with an indenting surface having a general pyramid shape, and means for stopping forward movement of the ram at a predetermined distance of the top of the pyramid shape from the anvil. The means for stopping forward movement comprises a forward portion of the ram, located behind the pyramid shape, being adapted to contact the anvil surface and stop forward movement of the ram. The method further comprises advancing the ram from a first position into contact with an exterior of a connector, the connector being sandwiched between the ram and the anvil; deforming the connector by advancing the ram past its contact position with the connector; and stopping the forward advancement of the ram upon the occurrence of a predetermined force between the ram and anvil. The predetermined force can occur either directly between the ram and anvil at the means for stopping movement when crimping a connector and conductor of a first size or, the predetermined force can occur between the ram and anvil through the connector when crimping a connector and conductor of a second relatively larger size.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
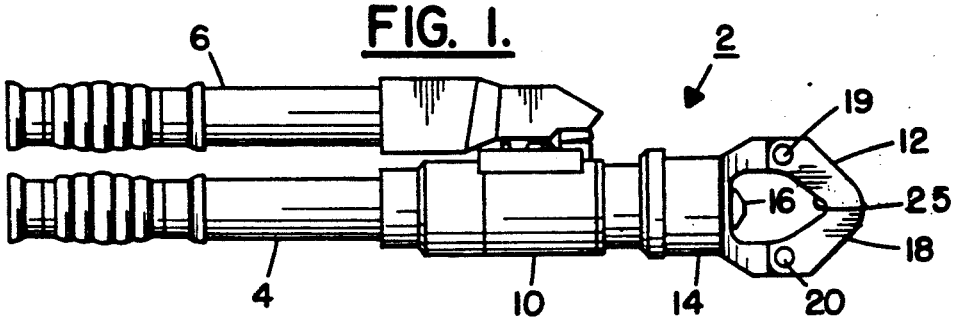
FIG. 1 is a plan side view of a hydraulic compression tool incorporating features of the present invention.

Referring to FIG. 1, there is shown a plan side view of a hydraulic compression tool 2 corporating features of the present invention. The tool 2 generally comprises a first handle 4 having a fluid reservoir therein, a second handle 6, a body 10, and a compression head 12. Although the present invention is being described with reference to a hydraulic compression tool, it should be understood that the invention can be incorporated into any suitable type of compression apparatus or crimping tool. In addition, any suitable size, shape, or type of materials can be used.

The hydraulic compression tool 2 shown in FIG. 1, with the exception of its compression head 12, is essentially identical to the hydraulic compression tool shown and described in U.S. Pat. No. 4,947,672 to Pecora et al. which is hereby incorporated by reference herein in its entirety. The compression head 12 generally comprises a cylinder body or frame 14 having a hydraulic cylinder therein, and an indentor or ram 16 movably mounted to the frame. Connected to the cylinder body or frame 14 is an anvil 18. The anvil 18 is connected to the frame 14 by two pins 19 and 20. In the embodiment shown, the second pin 20 is removable from the anvil 18 such that the anvil can pivot at pin 19 to open an area 22 intended to receive a connector.

The anvil 18 is generally comprised of metal with a center section 24 and two end sections 26 and 27 having slots 28 and 29 for receiving forward legs 30 and 31 of the frame 14 such that the pins 19 and 20 can fixedly mount the anvil 18 to the frame 14. The interior side of the center section 24, adjacent area 22, generally forms the anvil surface 25 of the tool 2 for contacting the exterior of a connector. In the embodiment shown, the anvil surface 25 includes two angled side portions or surfaces 32 and 33 with a center flat portion 34 therebtween at the center of the anvil 18. The two angled side portions 32 and 33 are angled about 75 degrees relative to each other. However, any suitable type of angle or shape of the anvil surface 25 can be provided as further described below.

Figure 4:
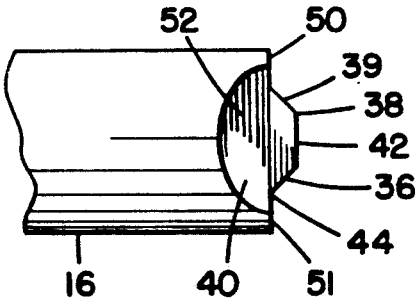
FIG. 4 is a side view of the front of the ram shown in FIGS. 1 thru 3.
Figure 5:
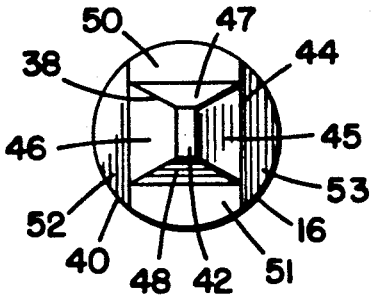
FIG. 5 is a plan top view of the ram shown in FIG. 4.
Figure 6:
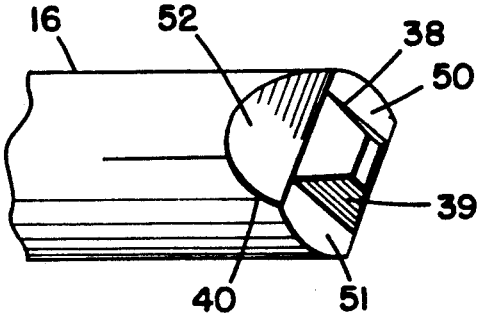
FIG. 6 is a partial perspective view of the front of the ram shown in FIG. 5.

The ram or indentor 16 is generally comprised of metal with a rear section (not shown) that is capable of being pushed forward by hydraulic fluid to advance the indentor 16 relative to the frame 14 and anvil 18. As described above, the ram 16 is movably mounted to the frame 14 for movement towards and away from the anvil 18. Referring also to FIGS. 4–6, the front 36 of the ram 16 is generally comprised of two portions or sections; a pyramid section 38 forming the leading edge to the ram, and an angled side section 40 located longitudinally behind the pyramid section 38. In the embodiment shown, the pyramid section 38 is comprised of a single four sided pyramid 39 with a flat top 42, base 44 and sides 45, 46, 47, 48. In the embodiment shown, the first two opposite sides 45 and 46 are angled relative to each other at an angle of about 109 degrees. However, any suitable angle can be provide as further described below. In the embodiment shown, extending from the base 44 at opposite sides 47 and 48 of the pyramid 39 ar two flat sections 50 and 51. Extending from the base 44 from sides 45 and 46 of the pyramid are two angled surfaces 52 and 53 that form the angled side section 40 of the indentor 16. In the embodiment shown, the surfaces 52 and 53 have an angle of about 75 degrees relative to each other. Thus, in the embodiment shown, the angle of the ram angled surfaces 52 and 53 is the same as the angle of the anvil angled contact surfaces 32 and 33.

Figure 2:
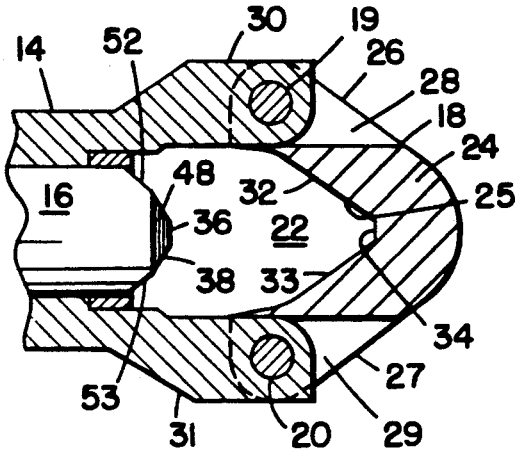
FIG. 2 is a partial schematic cross sectional view of the compression head of the tool shown in FIG. 1 with the ram at a first position.
Figure 3:
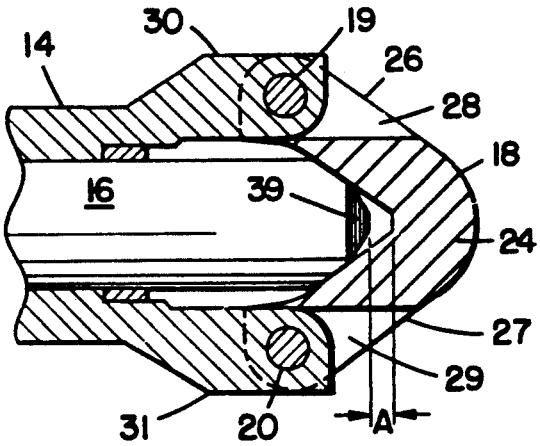
FIG. 3 is a schematic cross sectional view of the compression head as in FIG. 2 with the ram at a second position.

In the embodiment shown, the indentor 16 has a potential range of motion from a home position as shown in FIG. 2 through to its end of range of motion at a fully extended position as shown in FIG. 3. At the fully extended position the angled surfaces 52 and 53 of the ram side section 40 matingly contacts the angled contact surfaces 32 and 33 of the anvil 18. Thus contacted, the ram 16 is prevented from further advancement. In the embodiment shown, the pyramid section 38 is suitably sized and shaped such that when the indentor 16 is moved to its fully extended position, the pyramid 39 is spaced from the anvil and has a spacing A between the anvil center portion 34 and the pyramid's top 42. In a preferred embodiment of the invention, the spacing A is about 0.26 inch. However, any suitable spacing could be provided.

The novel configuration of the ram front 36 and anvil surface 25 allows the tool 2 the ability to crimp connectors onto conductors for both relatively large connectors and relatively small connectors, without significant crimp quality variation. Generally, when crimping a large connector onto a large conductor the ram 16 is advanced by pumping the handles 4 and 6 until the connector is sandwiched in area 22 between the ram front 36 and anvil surface 25. The handles 4 and 6 are further pumped with the ram 16 advancing and deforming the connector with the conductor. As the ram moves forward, the pyramid 39 presses into the connector without piercing the connector. Once the pyramid 39 is well embedded with the connector, the flat sections 50 and 51 contact the connector to increase the area of the ram front that is in compressing contact with the connector. Eventually, due to the increased area of contact between the ram front 36 and the connector, insufficient hydraulic pressure in the tool 2 prevents the ram from achieving sufficient force, because of the increased area, and being further advanced, thus resulting in a proper crimp without piercing the conductor.

When crimping small diameter connectors, the flat sections 50 and 51 do not substantially come into play. Basically, the connector is merely crimped between the pyramid 39 and anvil 18. The depth of the crimp into the small connector is controlled by the spacing A. As the ram advances the pyramid 39 indents into the connector. The pressure in the hydraulic system of the tool 2 never reaches its blow off pressure to stop crimping until the ram 16 contacts the anvil 18. As shown in FIG. 3, when the ram 16 contacts the anvil 18 the pyramid, due to its relatively modestly sloped sides 45 and 46 and its height, does not contact the anvil 18, thus establishing a predetermined spacing between the pyramid and anvil surface for a predetermined crimp and shape.

It should be noted that the tool 2 blows off on pressure, not travel distance. Thus, the tool 2 is capable of crimping range taking connectors. For range taking connectors, however, since the conductor is a smaller size than the connector, the ram 16 can obviously advance even after the flat area 50 and 51 contact the connector until such time as the connector is suitably crimped onto the conductor with suitable pressure. Although the anvil surface 25 has been described above as a wedge shape with two flat angled surfaces 32 and 33 with a flat section 34 therebetween, it should be understood that any suitably shaped anvil surface could be provided including curved surfaces and stepped surfaces. In addition, the anvil angled surfaces can have any suitable angled so long as the pyramid 39 is suitably sized and shaped to be spaced from the anvil surface 25 at the ram's fully extended position. Although the means for stopping the forward advancement of the ram 16 has been described as the abutment of the ram angled surfaces 52 and 53 meeting the anvil surfaces 32 and 33, it should be understood that any suitable means could be used to stop the advancement of the ram 16 at its fully extended position. In addition, although the pyramid 39 has been described as a four sided pyramid with a flat top, any suitably shaped extension at the leading edge of the ram could be provided and the term pyramid used herein should be interpreted as such. The indenting extension or pyramid 39 could also be provided on the anvil surface 25 or could be provided as multiple pyramids.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. An electrical connector crimping tool comprising:

a frame;

a ram movably mounted to said frame along an axis, said ram having a front with a first portion having a top section adapted to contact a connector and two angled sides obliquely oriented relative to said axis, the top section being substantially flat with each angled side being immediately adjacent said flat top section, and a second portion having an indenting extension, said second portion forming a leading edge of said ram and being located totally in front of said first portion;

an anvil connected to said frame, said anvil having two angled sides oriented obliquely to said axis and adapted to be matingly contacted by said ram first portion angled sides when said ram is advanced into contact with said anvil, aid flat top section being spaced from said anvil when said anvil angled sides contact said ram first portion angled sides; and means for moving said ram relative to said anvil to crimp an electrical connector therebetween such that said ram second portion can indent into the connector and relative movement of said ram towards said anvil can be stopped by said ram first portion angled sides contacting said anvil angled sides and, said ram first portion top section can contact the connector to increase contact area between said ram and the connector without said ram first portion angled sides contacting said anvil angled sides.

2. A tool as in claim 1 wherein said ram first and second portions are suitably sized and shaped such that contact of said first portion angled sides with said anvil angled sides stops forward advancement of said ram with said second portion being spaced a predetermined distance from said anvil.

3. A tool as in claim 2 wherein said predetermined distance is about 0.26 inch.

4. A tool as in claim 1 wherein said indenting extension has a flat top.

5. A tool as in claim 1 wherein said indenting extension is a general pyramid shape with four sides.

6. A tool as in claim 1 wherein said two angled sides extend from said base of said pyramid shape.

7. A head for a compression tool comprising:

a frame;

an anvil connected to said frame and having two angled contact surfaces; and a ram movably mounted along an axis in said frame for movement towards and away from said anvil angled surfaces, said ram having a front with a pyramid shape, two angled side portions oriented obliquely relative to said axis and located on opposite sides of a base of said pyramid shape adapted to matingly contact said anvil angled contact surfaces in a complementary manner, and two flat sections located on opposite sides of said base of said pyramid shape between said two angled side portions with each flat section forming an edge along each angled side portion, said pyramid shape being suitably sized so as to be positioned between said anvil contact surfaces, but not to contact said anvil when said ram side portions contact said anvil contact surfaces, and said two flat sections being spaced from said anvil when said anvil angled contact surfaces contact with the ram angled side portions.

8. A head as in claim 7 wherein said anvil contact surfaces are angled about 75 degrees relative to each other.

9. A head as in claim 8 wherein said ram angled side portions are angled about 75 degrees relative to each other.

10. A head as in claim 8 wherein said pyramid shape has sides angled about 109 degrees relative to opposite sides.

11. A head as in claim 7 wherein said pyramid shape has a flat top.

* * * * *